United States Patent [19]

Okayasu

[11] Patent Number: 4,625,790

[45] Date of Patent: Dec. 2, 1986

[54] HEAT TRANSPORT APPARATUS

[76] Inventor: Kenji Okayasu, No. 20-15, Mukai-machi, Gyouda-shi, Saitama-ken, Japan

[21] Appl. No.: 757,605

[22] Filed: Jul. 22, 1985

[30] Foreign Application Priority Data

Jul. 24, 1984 [JP] Japan ..... 59-153442

[51] Int. Cl.[4] ..... F28D 15/00

[52] U.S. Cl. ..... 165/104.22; 165/104.29; 165/104.31; 417/209

[58] Field of Search ..... 165/104.22, 104.29, 165/104.31, 104.24; 417/209

[56] References Cited

U.S. PATENT DOCUMENTS

| | | | |
|---|---|---|---|
| 3,392,781 | 7/1968 | Zuber et al. | 165/104.24 |
| 3,929,305 | 12/1975 | Sabol | 165/104.22 |
| 4,120,172 | 10/1978 | Pierce | 165/104.31 |
| 4,212,593 | 7/1980 | Chadwick | 417/209 |
| 4,383,643 | 5/1983 | Sohn | 417/209 |

FOREIGN PATENT DOCUMENTS

| | | | |
|---|---|---|---|
| 1558551 | 1/1980 | United Kingdom | 165/104.22 |
| 2081435 | 2/1982 | United Kingdom . | |

OTHER PUBLICATIONS

Study on the Heat Driven Pump (Yamamoto, Takamura & Tanaka).

Device for Passive Downward Heat Transport (Beni, Friesen, Veneroni).

*Primary Examiner*—Albert W. Davis, Jr.

*Attorney, Agent, or Firm*—Brumbaugh, Graves, Donohue & Raymond

[57] ABSTRACT

A heat transport apparatus comprises a closed circuit including a heating block and a radiator, the heating block being provided with a recess for producing a small bubble. The bubble is grown by heating the heating block, whereby working fluid is displaced and made to circulate through the radiator.

2 Claims, 12 Drawing Figures

HEAT TRANSPORT APPARATUS

BACKGROUND OF THE INVENTION

This invention relates to a heat transport apparatus which is capable of transporting heat from a heat absorption section to a heat release section without using any external mechanical drive only by heating and simultaneously circulating a liquid.

Heretofore, heat pipes, heat siphons, etc. have been well known as heat transport apparatus. However, these known apparatus cannot be used for long-distance heat transportation or for transporting heat downward against the force of gravity, since they utilize capillary attraction or gravity. On the other hand, a loop-type heat transport element has been developed in order to eliminate these faults. In such a loop-type heat transport element, however, two loop-shaped heating tubes are required at the heating section, and the heating section has to be positioned above the cooling section and also below the bends of tubes for connection between the heating and cooling sections. In addition, the two heating tubes should be somewhat inclined. Thus, the loop-type heat transport element is of complicated structure, has several limitations or manner of installation and cannot be used in a portable form except so that it is limited to application in a fixed installation such as a chemical plant.

SUMMARY OF THE INVENTION

An object of the invention is to provide a heat transport apparatus capable of transporting heat from a heat absorption section to a heat release section without any adverse influence from gravity or need for any external mechanical drive.

The heat transport apparatus according to the invention comprises a heating block made of material having a high heat conductivity and having a conical recess formed therein to produce a small bubble, pipe means made of material having a low heat conductivity, the heating block being positioned in the pipe means and arranged to be heated for growing of the bubble, flapper-type check valves provided at the ends of the pipe means, the growing bubble increasing the pressure of a working fluid in the pipe means, the increased pressure causing one check valve to open and the other check valve to close, thereby displacing the working fluid through the opened check valve under the action of the grown bubble, further pipe means connected between an inlet opening of one of the check valves and an outlet opening of the other check valve for circulating the working fluid to pass it through the other check valve into the heating block when the bubble is constricted, and a radiator positioned in the further pipe means for radiating heat from the working fluid.

In a preferred embodiment of the invention, an accumulator may be positioned in the further pipe means.

BRIEF DESCRIPTION OF THE DRAWINGS

A preferred embodiment of the invention is described in detail in this specification and illustrated in the accompanying drawings wherein.

DETAILED DESCRIPTION OF THE PREFERRED EMBODIMENT

Figure 1:
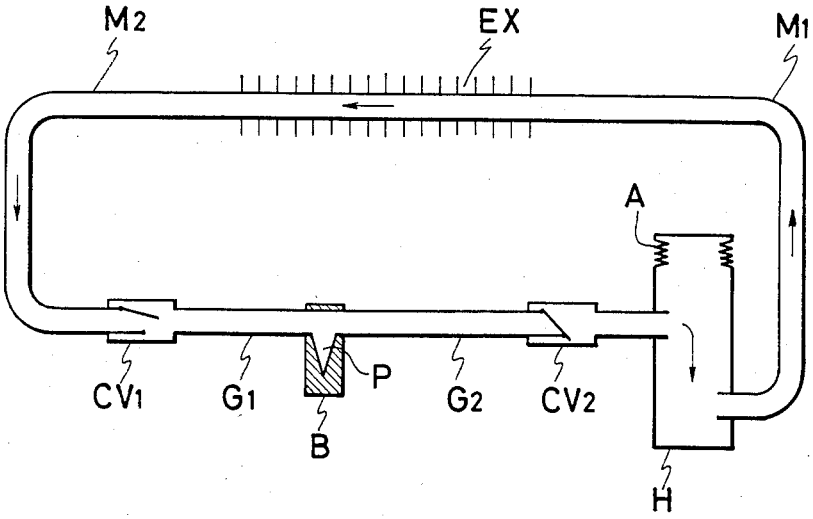
FIG. 1 is a sectional view of a heat transport apparatus according to the invention.

Referring now to FIG. 1 of the drawings, a heat transport apparatus according to the invention comprises a heating block B having a conical recess P formed therein and connected between pipes $G_1$ and $G_2$. The heating block B is made of any suitable material having a high heat conductivity while pipes $G_1$ and $G_2$ are of a material having a low heat conductivity. A check valve $CV_1$ is provided at the inlet end of the pipe $G_1$ and a check valve $CV_2$ is provided at the outlet end of the pipe $G_2$, which is connected to the inlet opening of an accumulator H having bellows A formed from any suitable flexible material. A pipe $M_1$ extends from the outlet opening of the accumulator H to the inlet opening of a radiator EX which is connected at its outlet opening to the check valve $CV_1$ by means of a pipe $M_2$. With such an arrangement, the heat transport apparatus forms a closed circuit in which working fluid is contained.

Figure 2:
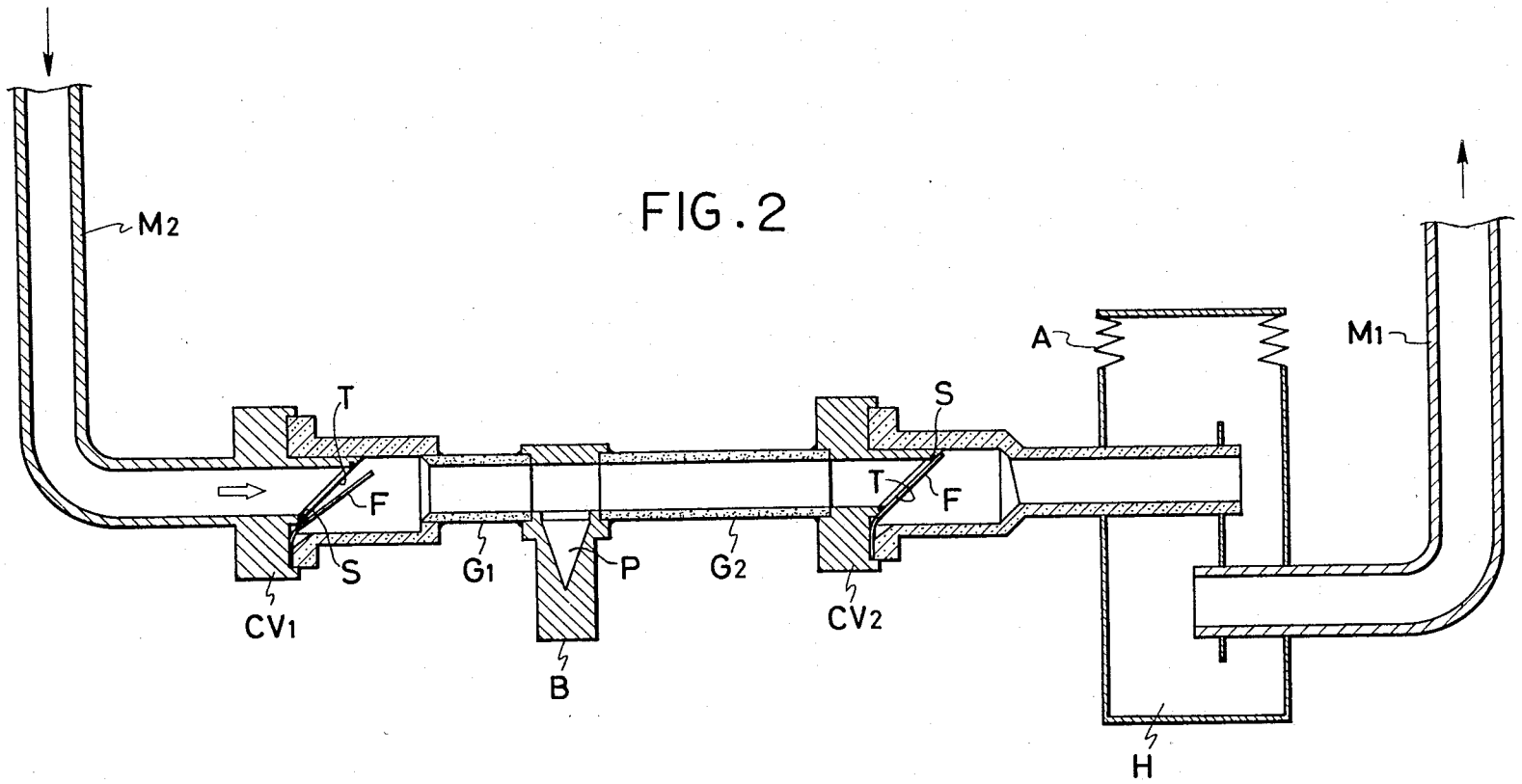
FIG. 2 is a view showing in detail a pumping section of the heat transport apparatus.
Figure 3:
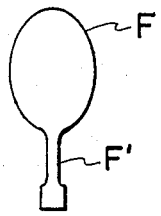
FIG. 3 is a front elevational view of a flapper of the check valves used in the heat transport apparatus.
Figure 4:
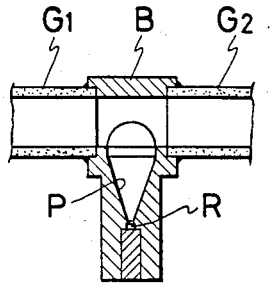
FIG. 4 is a cross-sectional view of a modification of a heating block of the heat transport apparatus.
Figure 5:
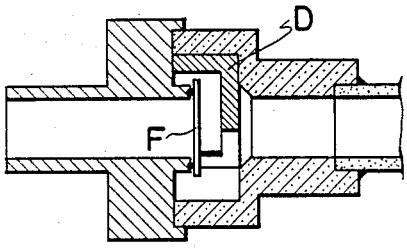
FIG. 5 is a view of a modified check valve.
Figure 6:
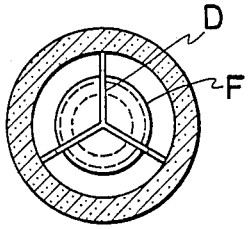
FIG. 6 is a front elevational view of the check valve shown in FIG. 5.

The cone of the recess P in the heating block B best shown in FIG. 2 of the drawings has an angle smaller than the angle of contact between the working fluid and the material of the heating block, whereby a bubble seed is produced at the apex of the conical recess P when the working fluid flows thereinto. Each of the check valves $CV_1$ and $CV_2$ includes a flapper F formed from a sheet of rubber or metal foil, and an inclined seat T having sealing O-ring S positioned therein and cooperating with the flapper F. As shown in FIG. 3, flapper F is provided with leaf spring F′ formed integrally therewith to provide a weak force with which the flapper is urged into contact with the sealing ring S on the seat T when fixed at its end to the check valve. The heating block may be provided with a cavity R formed therein at the apex of the conical recess P as shown in FIG. 4. FIGS. 5 and 6 show a circular flapper F positioned perpendicular to the flow of the working fluid and movably retained in a retainer D.

Pipes $M_1$ and $M_2$ may be of metal or of a flexible plastic such as vinyl chloride. The radiator EX may comprise a tube made of any suitable material having a high heat conductivity and fins of the same material positioned around the tube.

The working fluid is preferably water, but any suitable cooling medium (R-11, R-12, ammonia or the like) may be used as the working fluid.

Figure 12:
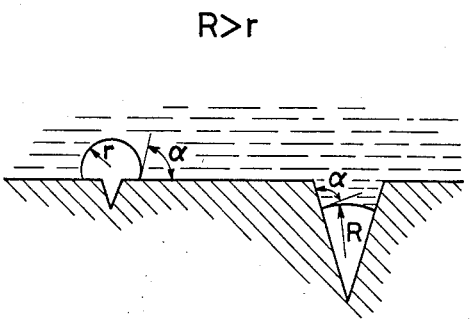
FIG. 12 is a view showing the relationship between a recess in the heating block and the growth of a bubble.
Figure 7:
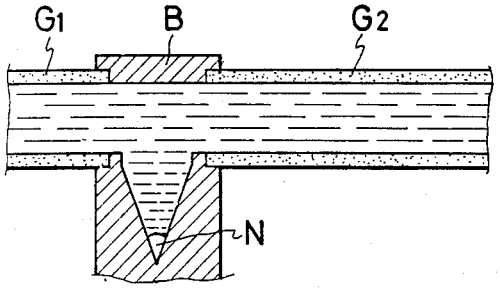
FIGS. 7 through 11 are views of the heat transport apparatus according to the invention in operation illustrating how the working fluid is pumped.
Figure 8:
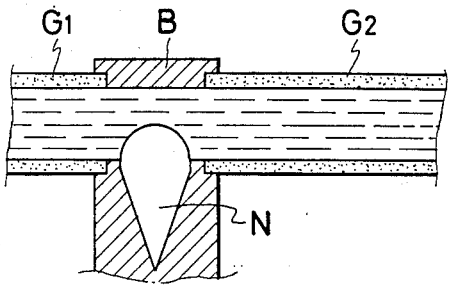

The closed circuit of the heat transport apparatus is filled with the working fluid, but since the angle of the cone of the recess P in the heating block B is smaller than the angle of contact between the material of the heating block and the working fluid, the conical recess P is not completely filled with the working fluid so that a bubble seed N is left at the apex thereof (see FIG. 7). The working fluid covering the bubble seed N is heated in the conical recess P by heating the heating block B from its outside by any suitable heat source. As the temperature of the heated working fluid exceeds the saturation temperature of the working fluid vapor at the internal pressure in the bubble seed N, the working fluid evaporates towards the bubble at the interface between the working fluid and the bubble so that the bubble N can begin to grow (see FIG. 8). As can be seen in FIG. 12, the amount of vapor pressure or superheating required to grow a bubble of identical volume is smaller in the case of a large conical recess than in the case where a small bubble seed is grown on a flat surface. This is because in case of the larger conical recess, the radius of curvature at the interface between the bubble and the working fluid is longer than that in case of the flat surface, and the surface tension on the interface which tends to constrict the bubble, is inversely proportional to the radius of curvature.

Figure 9:
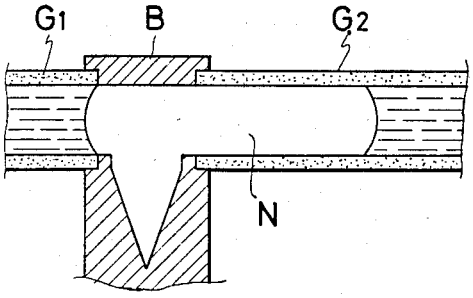
Figure 10:
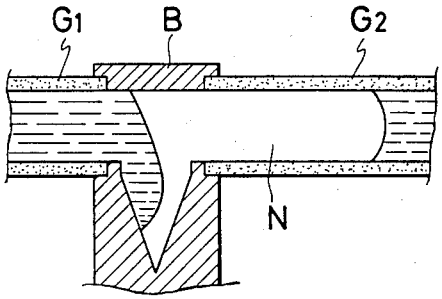
Figure 11:
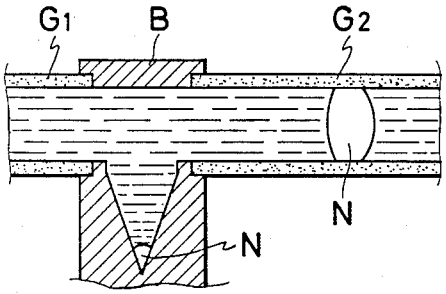

The continuously growing bubble increases the pressure of the working fluid in the pipes $G_1$ and $G_2$, whereby the check valve $CV_1$ is closed and the check valve $CV_2$ is opened. Thus, the working fluid in the pipe $G_2$ is displaced out through the open check valve $CV_2$ into the accumulator H by the continuously growing bubble N. The surface area of the bubble increases as its grows on the side of the pipe $G_2$ but growth of the bubble stops when the amount of evaporation of the working fluid at the heating block becomes identical with the amount of condensation of vapor on the increased surface area of the bubble (FIG. 9). The working fluid in the pipes $G_1$ and $G_2$ is heated mainly by the heat given off by condensation of the vapor. It will be noted that an amount of the working fluid which is identical with the volume of the grown bubble in the pipe $G_2$ and the conical recess P flows into the accumulator H so that the flexible bellows A expand outwardly. When the amount of condensation of vapor within the bubble comes to exceed the amount of evaporation, the bubble begins to constrict. When the pressure in the bubble becomes lower than that in the accumulator, the check valve $CV_2$ is closed while the check valve $CV_1$ is opened. Constriction of the bellows then causes the working fluid to flow from the accumulator through the pipe $M_1$, the radiator EX, the pipe $M_2$, and the check valve $CV_1$ into pipe $G_1$, thereby forcing the working fluid into the heating block B. The heating block B is cooled by the working fluid flowing thereinto to further constrict the bubble, thereby creating a negative pressure with which the working fluid is drawn from the accumulator through the radiator EX and then, through the heating block B into the pipe $G_2$. As a result, the bubble momentarily disappears. At the same time, a fresh bubble seed N is forms at the apex of the conical recess P of the heating block B (see FIGS. 10 and 11).

It will be noted from the foregoing that the working fluid is intermittently circulated in the closed circuit due to pressure differential created by the growth and constriction of the vapor bubble. Therefore, operation of the heat transport apparatus can be carried out in any attitudes without beding disturbed by the force of gravity. It therefore can be applied to portable equipment. Only slight heating is required to heat the heating block for growth of the bubble. Since the check valve is in the form of a flapper valve which can sensitively respond to extremely small pressure differentials, dry-out does not occur even when only a slight amount of heat is supplied to the heating block. The amount of the circulating working fluid increases in proportion to the amount of heat, and dry-out does not occur even when the temperature of the working fluid flowing through the check valve $CV_1$ into the heating block considerably increases. The accumulator H serves to trap non-condensable gases contained in the working fluid, by the difference in density, thereby preventing the non-condensable gases from circulating in the closed circuit. If the pipes $M_1$ and $M_2$ are formed from flexible material, no accumulator is required because the flexible pipes function as an accumulator.

What is claimed is:

1. A heat transport apparatus comprising a heating block made of material having a high heat conductivity and having a recess means formed therein to produce a small bubble, pipe means made of material having a low heat conductivity and adapted to contain a working fluid, the heating block being positioned with its recess in fluid communication with the interior of the pipe means and arranged to be heated for growing a bubble in said working fluid, flapper-type check valves provided at the ends of the pipe means and arranged so that the growing bubble increases the pressure of the working fluid in the pipe means, the increased pressure causing one check valve to open and the other check valve to close, thereby displacing the working fluid through the opened check valve under the action of the grown bubble, further pipe means connected between an inlet of one of the check valves and an outlet of the other check valve for circulating the working fluid to pass it through the other check valve into the heating block when the bubble is constricted, and a radiator positioned in the further pipe means for radiating heat from the working fluid.

2. An heat transport apparatus as claimed in claim 1 wherein an accumulator is positioned in the further pipe means.

* * * * *